US009187235B2

(12) United States Patent
Ebner

(10) Patent No.: US 9,187,235 B2
(45) Date of Patent: Nov. 17, 2015

(54) SYSTEM FOR FEEDING TICKETS FROM TWO TICKET CONTAINERS

(71) Applicant: SKIDATA AG, Groedig-Salzburg (AT)

(72) Inventor: Norbert Ebner, Salzburg (AT)

(73) Assignee: SKIDATA AG, Groedig/Salzburg (AU)

( * ) Notice: Subject to any disclaimer, the term of this patent is extended or adjusted under 35 U.S.C. 154(b) by 133 days.

(21) Appl. No.: 14/152,135

(22) Filed: Jan. 10, 2014

(65) Prior Publication Data

US 2014/0217228 A1 Aug. 7, 2014

(30) Foreign Application Priority Data

Feb. 5, 2013 (EP) ..... 13154000

(51) Int. Cl.
*B65D 83/12* (2006.01)
*G07F 17/42* (2006.01)
*G07B 5/00* (2006.01)

(52) U.S. Cl.
CPC *B65D 83/12* (2013.01); *G07B 5/00* (2013.01); *G07F 17/42* (2013.01)

(58) Field of Classification Search
CPC ..... B65D 83/12; G07B 5/00; G07B 15/02; G07F 17/42
USPC ..... 242/594, 594.4
See application file for complete search history.

(56) References Cited

U.S. PATENT DOCUMENTS

| | | | | | |
|---|---|---|---|---|---|
| 2,872,007 | A * | 2/1959 | Robb et al. | 194/314 |
| 3,397,818 | A * | 8/1968 | Rey | 221/232 |
| 3,554,847 | A * | 1/1971 | Broemmlsiek | 156/767 |
| 3,997,044 | A * | 12/1976 | Schasser | 194/211 |
| 4,047,652 | A * | 9/1977 | Ehrlund | 225/54 |
| 5,337,897 | A * | 8/1994 | Yablans | 206/581 |
| 5,695,107 | A * | 12/1997 | Shoemaker, Jr. | 226/39 |
| 2004/0043813 | A1 | 3/2004 | Chamberlain et al. | |
| 2006/0293783 | A1 | 12/2006 | Hand et al. | |
| 2007/0204737 | A1 * | 9/2007 | Finkenbiner | 83/649 |
| 2010/0044425 | A1 | 2/2010 | Naccache | |
| 2012/0043375 | A1 | 2/2012 | Ueda et al. | |

* cited by examiner

*Primary Examiner* — Sang Kim
(74) *Attorney, Agent, or Firm* — Karl F. Milde, Jr.; Eckert Seamans Cherin & Mellott, LLC

(57) ABSTRACT

A system for feeding tickets (6) from two ticket containers (1, 2) to a ticket-encoding device, particularly for a ticket-encoding device within a parking-meter post (13) in combination with a vehicle barrier, comprises a receptacle (3) for two ticket containers (1, 2) that are mounted adjacent to each other, whereby a component (4, 4') is assigned to each ticket container (1, 2) that, viewed toward the longitudinal axes (14, 15) of the ticket containers (1, 2) is mounted at one end of the ticket containers (1, 2) and includes a slot (5) provided with rollers, guide plates, or brushes through which the tickets (6) are fed. A securing plate (7), mounted above the ticket containers (1, 2), has two slots (8, 9) arranged in parallel for receiving the tickets.

4 Claims, 1 Drawing Sheet

SYSTEM FOR FEEDING TICKETS FROM TWO TICKET CONTAINERS

BACKGROUND OF THE INVENTION

The invention relates to a system for feeding tickets to a ticket-coding device from two ticket containers. Particularly, the invention relates to a system for feeding tickets from at least two ticket containers that are integrated into a parking gate post or column that operates in combination with a vehicle barrier, or into an automated sales device for tickets.

It is known from prier art to integrate ticket feeing devices into parking gate columns whereby the tickets are subsequently fed to a ticket-encoding device that for example, encodes the tickets with a barcode and/or imprints the tickets with the necessary information. During this, it is important to maximize ticket capacity of parking gate columns while keeping the operating expense to refill the ticket containers and the down-time of the parking gate columns as low as possible.

However, since the space available for the ticket containers within a parking-gate column is limited by the dimensions of the parking gate column, the necessity arises of maximizing the ticket capacity while simultaneously minimizing the volume required.

It is also known from prior art to use a device to gather tickets from two ticket containers that comprises a spiral guide track for the tickets that serves to overcome the lateral displacement when gathering the tickets from the second container. The first ticket container here is mounted directly beneath the ticket-encoding device so that the tickets from this container are drawn vertically from below into the ticket-encoding device. The second container is offset laterally alongside the first ticket container as a rule, whereby the spiral guide track is mounted above the second ticket container and behind or in front of the gathering of the first ticket container.

This configuration disadvantageous allows for the use of lower ticket containers at the same mounted height.

Further, the use of a spiral guide track may disadvantageously lead to tilting or binding of tickets during supply. Per prior art, tickets are wound in a spiral channel, which results in inconvenience upon initial supply (i.e., when a new ticket container is inserted). Furthermore, tickets supplied to the ticket-encoding device in this manner may easily be tilted and jammed. Also, with devices to gather tickets known to prior art high relative humidity and high ambient air temperature may lead to sticking of the thermal layers of the tickets in the containers, which can lead to a ticket jam in connection with a guide spiral since the stuck-together tickets cannot be separated and supplied properly.

SUMMARY OF THE INVENTION

It is the task of this invention to pro de a system for feeding tickets from two ticket containers to a ticket-encoding device by means of which the above-mentioned disadvantages sa of pr art devices and systems ire avoided. The system based on the invention must increase ticket capacity while minimizing the volume required. Particularly the system based on the invention must be capable of integration into a parking gate column without requiring alteration of the dimensions of the parking gate column. Furthermore, the supply reliability must be increased and the servicing expense must be minimized.

According the invention, a system for feeding tickets from two ticket containers to a ticket-encoding device, particularly for a ticket-encoding device for a parking gate column in combination with a vehicle barrier, is proposed that includes a receptacle for two ticket containers that are adjacent to each other, whereby a component is assigned to each ticket container that is positioned at one end of the ticket containers as viewed along the longitudinal axes of the ticket containers, and that comprises a slot provided with a roller, guide plate, or brush through which the tickets are fed.

Per the invention, a securing plate for a ticket-encoding device is mounted above the ticket containers that comprises two gathering slots in parallel with each other for the tickets, each of which is assigned to a ticket container. Here, the ticket containers are positioned such that they are in parallel to each other with respect to their longitudinal axes, and are displaced from each other when viewed along their longitudinal axes, whereby each of the slots of the components provided with a roller, guide plate, or brush is positioned at its opposite end when viewed toward the longitudinal axes of the ticket containers whereby the longitudinal axes of the ticket containers are rotated through a specific angle $\alpha$ with respect to the transverse axis of the gathering slot.

Further, the slots of the components provided with a roller, guide plate, or brush are positioned such that the slots of the components parallel to the plane defined by the securing plate when viewed from the side are located approximately at the midpoint of the intersecting points of the longitudinal axes and the transverse axes of the gathering slot, and when viewed vertically, are located approximately in the center between the upper edge of the ticket containers and the securing plate whereby the longitudinal axes of the slots of the components provided with rollers, guide plates, or brushes are rotated through a specific angle $\alpha/2$ with respect to the longitudinal axes of the gathering slot such that a projection of the surfaces of the ticket strip continuously rotates about the plane of the securing plate along the ticket path from the upper edge of the ticket container to the securing plate from the direction of the longitudinal axis of the ticket container only through the angle $\alpha$ in the direction of the transverse axis of the gathering slot.

The angle $\alpha$ lies in the interval between 10° and 30°, and is preferably 15°. Furthermore, per an advantageous embodiment example of the invention, the ticket containers are mounted such that they are offset along the longitudinal axes from one another by one-half of their length.

The obliqueness of the ticket containers per the invention provides re-routing of the tickets, removing the requirement of providing a spiral guide track.

This in turn allows better use of the available installation space since the installation space required for the spiral guide track may be used for larger ticket containers. It has previously only been possible to use 2×55 cm ticket containers, whereas the system based on the invention allows the use of 2×70 cm ticket containers.

Furthermore, the concept based on the invention allows avoidance of the problem arising with the use of a spiral guide track regarding tilting or binding of the tickets during supply.

The uppermost ticket is provided slight tension by means of the components assigned to the ticket containers comprising rollers, guide plates, or brushes, and through which the tickets are fed, whereby the remainder of the ticket pad with potentially adhered tickets is held back by the cardboard ticket cover.

For a full understanding of the present invention, reference should now be made to the following detailed description of the preferred embodiments of the invention as illustrated in the accompanying drawings.

DESCRIPTION Of THE PREFERRED EMBODIMENTS

Per the invention and with reference to FIGS. 1, 2, 3, and 4, the system based on the invention for feeding tickets 6 from two ticket containers 1, 2 to a ticket-encoding device, particularly for a ticket-encoding device for a parking gate column 13 combination with a vehicle barrier, comprises a receptacle 3 for two ticket containers 1, 2 whereby the ticket containers 1, 2 are positioned adjacent to each other.

Figure 1:
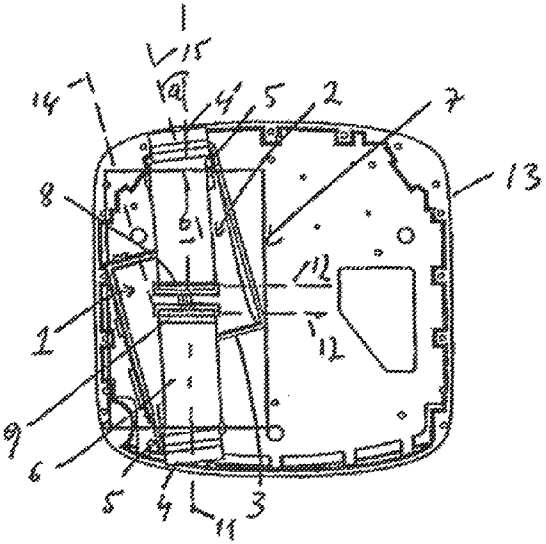
FIG. 1 is a schematic top view of a system based on the invention for feeding tickets from at least two containers to a ticket-encoding device.

As FIG. 1 shows, a component 4, is assigned to each ticket container 1, 2 that, viewed in the direction the longitudinal axes 14, 15 of the ticket containers 1, 2, is mounted one end of the ticket containers 1, 2, and comprises a slot provided with rollers, guide plates, or brushes through which the tickets 6 are fed. The components 4, 4' are permanently affixed. For example, the components 4, 4' may be connected to the housing of the parking gate column 13.

Using FIGS. 1-4 for reference, the system includes a securing plate 7 for a ticket-encoding device mounted above the ticket containers 1, 2 that comprises two parallel feeding slots 8, 9 for the tickets 9 shown transparently in FIG. 1, whereby each of the gathering slots 8, 9 is assigned to a ticket container 1, 2.

The ticket containers 1, 2 are mounted such that their longitudinal axes 14, 15 lie in parallel to each other and, viewed along these longitudinal axes 14, 15, are mounted offset to each other whereby each of the slots 5 of the components 4, 4' provided with rollers, guide plates, or brushes viewed along the direction of the longitudinal axes 14, 15 is mounted on the respective opposing ends.

Figure 4:
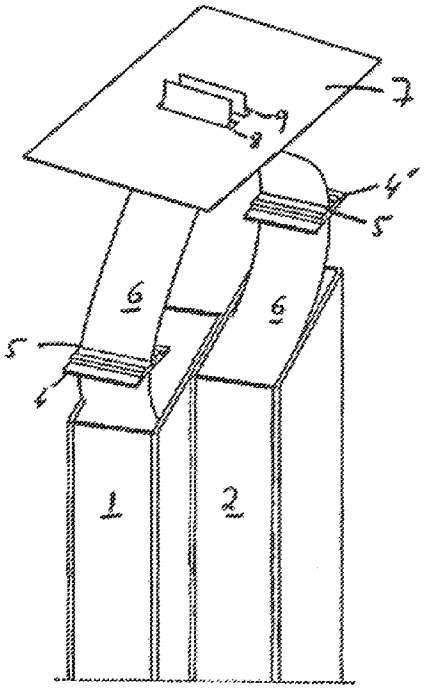
FIG. 4 is a schematic perspective view of a system based on the invention for feeding tickets from at feast two containers to a ticket-encoding device.
Figure 3:
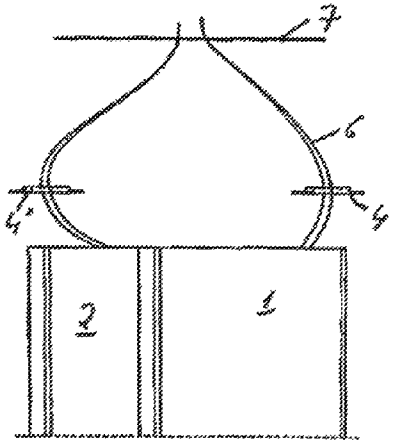
FIG. 3 is a second schematic side view of a system based on the invention for feeding tickets from at least two containers to a ticket-encoding device.
Figure 2:
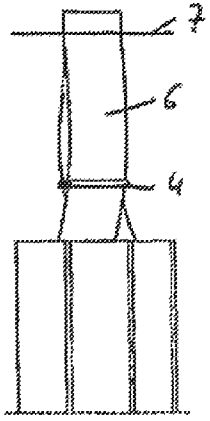
FIG. 2 is a first schematic side view of a system based on the invention for feeding tickets from at least two containers to a ticket-encoding device.

Furthermore, the longitudinal axes 14, 15 of the ticket containers 1, 2 are rotated through a specific angle $\alpha$ with respect to the transverse axis 11 of the feeding slots 8, 9 of the securing plate 7 whereby the components 4, 4' are mounted such that the slots 5 provided with rollers, guide plates, or brushes of the components 4, 4' are oriented in parallel to the plane defined by the securing plate 7 viewed laterally, and come to rest approximately at the midpoint of the intersecting points of the longitudinal axes 14, 15 of the ticket containers 1, 2 and the transverse axis of the gathering slots 8, 9, and as FIGS. 2, 3, and 4 show viewed vertically, are essentially positioned at the midpoint between the upper edge of the ticket containers 1, 2 und the securing plate 7.

With reference to FIG. 1, the longitudinal axes of the slots 5 provided with rollers, guide plates, or brushes of the components 4, 4' are rotated through a specific angle of approximately $\alpha/2$ with respect to the longitudinal axes 12 of the gathering slots 8, 9 of the securing plate 7 such that the projection of the surfaces of the ticket strip onto the plane of the securing plate 7 in the path of the tickets 6 from the upper edge of the ticket containers to the securing plate 7 from the direction of the longitudinal axes 14, 15 of the ticket containers 1, 2 continually rotates only through the angle $\alpha$ in the direction of the transverse axis 11 of the feeding slots 8, 9 of the securing plate 7.

In the embodiment shown in the figures, the ticket containers 1, 2 viewed along their longitudinal axes 14, 15 are mounted offset to each other by one-half the length of a ticket container 1, 2.

There has thus been shown and described a novel system for feeding tickets from two containers which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A system for feeding a strip of tickets from each of two elongate ticket containers to a ticket-encoding device, said system comprising, in combination: (a) a receptacle configured to hold the two elongate ticket containers which are mounted therein side by side, adjacent to each other, each of said ticket containers having two ends and a respective longitudinal axis extending lengthwise between said two ends; (b) a ticket guide component assigned to each ticket container and configured such that, viewed toward the longitudinal axes of the assigned ticket containers, each is mounted adjacent one of said ends of the respective ticket container, each such guide component comprising a slot through which tickets are fed; and (c) a securing plate mounted above the ticket containers and the guide components, said securing plate having two ticket feeding slots arranged parallel to said slot in a respective guide component so as receive tickets from the ticket container to which such guide component is assigned;

wherein the ticket containers are mounted such that their longitudinal axes are in parallel to each other and, viewed along these longitudinal axes, are offset with respect to each other, wherein the slots of the guide components, viewed along the longitudinal axes of the ticket containers, are mounted adjacent opposing ends of the ticket containers, wherein the longitudinal axes of the ticket containers are rotated through a specific angle ($\alpha$) with respect to the transverse axis of the ticket feeding slots, and the guide components are mounted such that the slots thereof are oriented in parallel to a plane defined by the securing plate viewed laterally and come to rest approximately at the midpoint of the intersecting points of the longitudinal axes of the ticket containers and the transverse axis of the ticket feeding slots and, viewed vertically, are essentially positioned at the midpoint between an upper edge of the ticket containers and the securing plate, and wherein the longitudinal axes of the slots of the guide components are rotated through a specific angle ($\alpha$)/2 with respect to the longitudinal axes of the feeding slots such that the projection of the surfaces of the ticket strips continually rotate only through the angle ($\alpha$) in the direction of the transverse axis of the ticket feeding slots onto the plane of the securing plate in the path of the tickets from the upper edge of the ticket container to the securing plate from the direction of the longitudinal axes of the ticket containers.

2. The system for feeding tickets defined in claim 1, wherein the ticket containers viewed along their longitudinal axes are mounted offset to each other by one-half the length of a ticket container.

3. The system for feeding tickets defined in claim 1, wherein the angle ($\alpha$) is in the range of 10° to 30°.

4. The system for feeding tickets defined in claim 3, wherein the angle ($\alpha$) is 15°.

* * * * *